US005096409A

United States Patent [19]

Stofko

[11] Patent Number: 5,096,409

[45] Date of Patent: Mar. 17, 1992

[54] SYSTEM FOR VAPOR INJECTION PRESSING

[75] Inventor: John Stofko, Beaverton, Oreg.

[73] Assignee: Carbocol Systems, Inc., Beaverton, Oreg.

[21] Appl. No.: 526,098

[22] Filed: May 21, 1990

[51] Int. Cl.[5] ..... B30B 15/00

[52] U.S. Cl. ..... 425/405.1; 100/73; 100/297; 425/411; 425/DIG. 47; 425/DIG. 119

[58] Field of Search ..... 100/73, 297; 425/338, 425/342.1, 383, 387.1, 405.1, 405.2, 406, 411, DIG. 47, DIG. 119

[56] References Cited

U.S. PATENT DOCUMENTS

| | | | |
|---|---|---|---|
| 3,619,450 | 11/1971 | Futo | 264/109 |
| 3,891,738 | 6/1975 | Shen | 264/120 |
| 3,914,079 | 10/1975 | Kober | 425/406 |
| 4,162,877 | 7/1979 | Nyberg | 425/406 |
| 4,183,997 | 1/1980 | Stofko | 264/109 |
| 4,267,142 | 5/1981 | Lankheet | 425/338 |
| 4,357,194 | 11/1982 | Stofko | 425/405.1 |
| 4,409,170 | 10/1983 | Stofko | 425/420 |
| 4,504,205 | 3/1985 | Stofko | 425/411 |
| 4,850,849 | 7/1989 | Hsu | 425/406 |
| 4,854,994 | 8/1989 | Breiter et al. | 425/338 |

FOREIGN PATENT DOCUMENTS

| | | | |
|---|---|---|---|
| 2742250 | 3/1978 | Fed. Rep. of Germany | 425/405.1 |
| 3818160 | 12/1989 | Fed. Rep. of Germany | 425/406 |

*Primary Examiner*—Richard L. Chiesa
*Assistant Examiner*—C. Scott Bushey
*Attorney, Agent, or Firm*—Browdy and Neimark

[57] ABSTRACT

Particle board, hard board, wafer board, plywood and the like are formed by vapor injection pressing using thin plates through which steam is injected into the product under consolidation, the thin plates lying adjacent the press platens. For closed steam pressing, the plate is provided with a peripheral seal which is inflatable to seal the cavity of the press using either the same stream which is injected into the product, or a second source of steam or other gas at a higher pressure.

5 Claims, 2 Drawing Sheets

SYSTEM FOR VAPOR INJECTION PRESSING

FIELD OF THE INVENTION

The invention relates to the consolidation of fibrous, particulate and/or laminar products by vapor injection pressing and to apparatus for facilitating same, and more especially to the consolidation of lignocellulosic material by steam injection pressing and to the conversion of an existing press to a steam injection press having a plate which when attached either to upper or lower press platens enables a uniform distribution of steam and/or other fluid to the products undergoing pressing.

BACKGROUND OF THE INVENTION

In the field of consolidation of composite products of lignocellulosic materials such as particleboard, hardboard, waferboard or plywood, it is known that by injecting and releasing steam into and out of the composite products during consolidation thereof using heat and pressure, several improvements are obtained, not the least of which is an increase of heat transfer rates that significantly speeds up the curing of thermosetting adhesives and results in lower swelling of the products. Several types of apparatus have been used for the introduction of steam into consolidation products.

Two general systems of steam injection pressing have been previously proposed, these being open pressing and closed pressing. In open steam injection pressing, steam is allowed to escape from the lignocellulosic board being formed through the open edges during pressing. Closed steam injection pressing, on the other hand, uses some type of a peripheral gasketing material or other means so that the steam is inhibited from escaping. Closed steam pressing is more efficient, but so far the design of a suitable gasket has proven illusive. Another problem with many of the prior art attempts is the use of massive platens, which substantially increases the capital cost, systems of this type being exemplified by the Corbin U.S. Pat. No. 3,280,257; Shen U.S. Pat. No. 3,891,738 and Nyberg U.S. Pat. No. 4,162,877.

For example, Shen U.S. Pat. No. 3,891,738 discloses a press platen which provides conventional internal heating by passing heating fluids through a closed labyrinth of interconnected passageways, and has an additional chamber and aperture openings on the surface adjacent to the product undergoing pressing through which steam is passed and injected into the product. In this arrangement, steam passes from a chamber of one press platen through the pressed product and from there into the opposite press platen, thereby speeding up curing of the thermosetting resins. Shen proposes a sealing frame carrying an asbestos gasket as a seal.

Nyberg U.S. Pat. No. 4,162,877 discloses the use of one platen which comes into contact with the product. Steam is injected from the press platen through the openings therein and into the product and is then released back through the same openings into the platen after curing of the thermosetting resin in the product. In the Nyberg construction, peripheral walls are used with built-in O-ring seals on the bottom sides of the walls, or attached on the inside of the wall siding along the press platens.

Futo U.S. Pat. No. 3,619,450 discloses a gas type envelope bellows consisting of Teflon sheet material suitably reinforced and sealed by a ring inserted between a metal ring and the platen. Clamps are required to secure the metal rings before steam injection takes place so as to ensure proper positioning and stability of the sealing ring.

The Hsu U.S. Pat. No. 4,850,849 employs steam injecting platens and border projection means generally configured to the outline of the end product and carried by the upper press platen which are intended to impinge and press into the mat at its edges to affect a steam pressure seal by excessive compression of the product along the periphery of the mat.

Stofko U.S. Pat. No. 4,409,170 discloses apparatus for forming porous products of low to medium density by consolidation of fibrous, particulate or laminar materials in the presence of a bonding agent under heat and pressure, comprising a press and at least one pair of pressing plates between which the consolidation of such materials is effected, including a peripheral seal surrounding the space between the pair of pressing plates when said plates are closed to press therebetween the materials to be consolidated to provide a closed and sealed pressing volume, at least one of the pair of pressing plates having horizontal permeability along its entire interiors and a vertical permeability along a central portion thereof, the pressing plate being flexible, thin, and of low mass and thermal capacity; and means to apply a fluid heat carrier to the interior of one of said pressing plates for passage of said heat carrier through the vertical permeability thereof.

Stofko U.S. Pat. No. 4,504,205 pertains to a press apparatus converted from a conduction press for consolidation of products by heat and pressure to a convection press therefor, comprising an upper press platen having a lower working face and a lower press platen having a upper working face; an upper caul plate attached to the lower working phase of the upper press platen; a lower caul plate on the upper working face of the lower press platen, each of said caul plates being formed with a central permeable area and a surrounding impermeable area along the peripheral edge thereof; sealing means for inhibiting fluid from escaping from the permeable areas of the caul plates; and steam feeding means provided in the upper and lower press plates for feeding steam from a source outside of the press platens to the central permeable area of said the plates.

It is known that metallic plates deform by uneven heating thereof and by imposing stresses upon them. Thick plates of high flexural rigidity (product of modulus of elasticity and moment of inertia of cross section) have the capability of resisting deformation, but these take up too much room in the opening of the press. Thin plates are easily deformed but also easily flattened by pressure. Plates of intermediate thickness deform and are not easily flattened. Pressures to which products are pressed are not sufficient to flatten them which results in uneven surface.

Another problem posed in the foregoing prior art closed steam injection pressing systems is the seal arrangement. The proposals of the aforementioned patents of Shen, Nyberg, Futo and the like for seals have not found practical application for several reasons, including complexity and difficulty of reliable sealing and easy usage. Because dependable seals have not yet been provided according to such prior art, closed steam pressing is not at present industrially used. Thus, it is extremely difficult to produce a perfect heat resistant seal along the periphery of a large press platen, which has an area of from 32 to 400 square feet, impermeable to gases of pressures up to 200 psi. In a closed steam injection pressing system, the seal has to be able to seal the space between press platens at variable thicknesses of products of from about one quarter to two inches. Therefore, the seal has to be very strong. For example, at a two inch distance between platens of about 4×8 feet area and 150 psi steam pressure, the force acting on inside surface of the seal is about 300 pounds for every inch of gasket length and this gives rise to a total force of about 9,600 pounds. Under such circumstances, the seal must remain flexible over a long period without fatigue and it must provide a tight seal under adverse conditions of particulate wood material, which is easily distributed over the area under the seal.

SUMMARY OF THE INVENTION

It is, accordingly, an object of the invention to overcome deficiencies in the prior art, such as indicated above.

Another object of the invention is to provide simple and reliable means for uniformly introducing steam or other gases to porous materials under consolidation under heat and pressure, especially lignocellulosic materials in the manufacture of particleboard, hardboard, waferboard and plywood, and for keeping such gases in place during pressing, and without the necessity of significant rebuilding of prior existing presses.

A further object of the present invention is to provide an improved system for steam injection pressing of lignocellulosic materials.

A still further object of the present invention is to provide improvements in means for injecting gases and means for sealing in injected gases in generic vapor injecting presses.

These and other objects in the nature and advantages of the present invention will become more apparent from the following descriptions. In general an apparatus aspect of the invention takes the form of a conversion kit which can convert an existing press to a steam injection press in a matter of only a few hours, thus obviating the necessity of large capital cost and large down-time with considerable production loss.

The conversion apparatus is constructed so as to accept steam from a source and distribute same uniformly to the product being pressed over its whole area and in a very short time. Such apparatus is thin so that it will not significantly reduce the size of the opening of the already existing press, is of constant thickness, and is substantially perfectly flat or flexible so that it can be easily flattened by low pressure so that it will not produce an uneven surface in the product where a flat product is desired.

In comparison with Stofko U.S. Pat. No. 4,504,205, which until the present invention was the best approach for converting prior presses to steam pressing, the present invention has the basic advantage that the steam injecting plate is independent of the platen in accepting and distributing steam to the product. Because according to the present invention the platens do not participate in the steam distribution, there is no need for a seal between the steam injection plates and the platens, and consequently the conversion of the press to steam pressing is simpler and less costly.

Thus the present invention introduces a new and improved relatively thin press plate, which when attached either to upper or lower press platens, enables a uniform distribution of fluids to be brought to the product during pressing and wherein the plate is independent of the press platens in accepting and distributing the steam to product under consolidation and wherein there is no need for the presence of a seal between the plates and the press platens. The plate comprises: an upper layer of a fluid impermeable sheet that forms one surface of the plate; a lower layer of a fluid permeable central sheet having peripheral strips which are impermeable to fluids; and an intermediate layer of a fluid permeable sheet having a peripherally extending fluid impermeable spacer between the upper sheet and the lower layer wherein the plate has a steam inlet line disposed to introduce steam into the fluid permeable space of the intermediate layer between said upper sheet and said lower sheet.

The invention further comprises a steam distribution plate/inflatable seal combination for use in consolidation of products in a closed steam injection pressing system, comprising: an upper central layer of a fluid impermeable or permeable sheet that forms one surface of the plate; a lower central layer of a fluid permeable sheet that forms a second surface of said plate; and a peripheral part of a hollow tubular seal device made of a fluid impermeable flexible inner layer made of a heat resistant flexible material reinforced by an outer flexible screen or other non-expandable material which is made impermeable to fluids by filling with said heat resistant plastic material, the tubular seal being inflatable with gas under pressure, e.g. with steam, introduced via an inlet line disposed to supply steam or other gas into the hollow of the seal.

Finally, the invention comprises an inflatable compressible tubular seal device for use with a steam distribution plate in a steam injection pressing system, wherein the tubular seal device comprises an inner area of a heat resistant fluid impermeable material which forms a wall of a tube and an outer area made of flexible non-expandable material such as wire screen which is made impermeable to steam by filling its open spaces with flexible plastic material such as rubber. The device has a steam inlet line to introduce steam into and inflate the tube to produce tight seal around the product between the press platens.

DETAILED DESCRIPTION OF THE PREFERRED EMBODIMENTS

Figure 1:
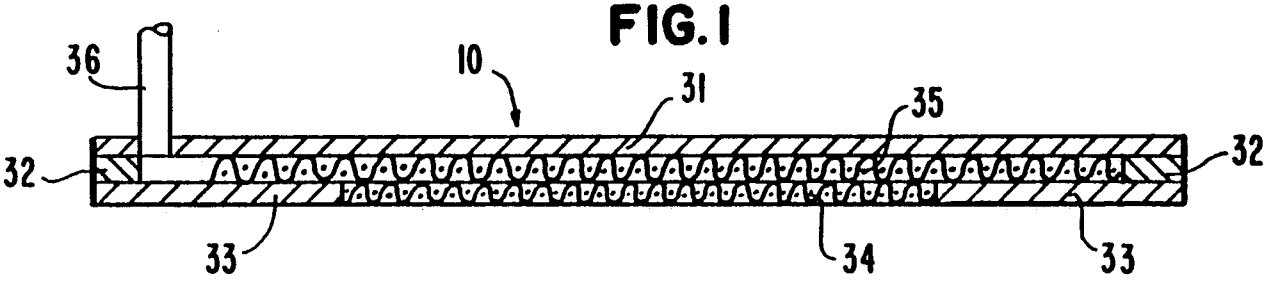
FIG. 1 is a cross sectional view of a steam distribution plate in accordance with the invention.

With reference to FIG. 1, there is shown a cross sectional view of a steam distribution plate 10 composed of a fluid impermeable sheet 31 which forms a continuous backing surface of the plate and a fluid impermeable peripheral strip 33 having a central fluid permeable sheet 34 therewithin which together constitute the opposite facing surface of the plate 10. Between sheet 31 on the one side and sheets 33 and 34 on the other, there is disposed a fluid permeable intermediate sheet 35 which has a narrow fluid impermeable peripheral strip 32 disposed thereabout to act as a spacer along the periphery of the plate. Sheets 31, 32 and 33 may be welded or otherwise fixed together in an airtight connected manner along the outer edge of said plate 10. A pipe 36 is provided for introduction of steam from a source to the spaces within sheet 35 and between sheets 31, 33 and 34. Sheets 31 32, and 33 are desirably thin sheet metal and sheet 34 is either perforated sheet metal or an open screen, and sheet 35 is an open screen. The steam distribution plate is of a low flexural rigidity (product of modulus of elasticity and moment of inertia of the cross section) and is therefore pliable and flexible.

A plate 10 of the construction of FIG. 1 may be attached either to the top or bottom or both of the press platens of any conventional press, so that the plate(s) 10 can serve for the introduction of fluids such as steam or other gases for open and closed steam pressing of products in otherwise conventional presses.

Thus, where open steam pressing is desirable, one or two plates 10 are attached to either the top or the bottom press platen or to both, and the pipe 36 is connected to a source of steam in order to ready it for open steam injection pressing. Because the plates are thin (e.g. as thin as 3/16") only a very small space of press opening will be taken up by the plates and therefore no other adjustments of the press is necessary.

Figure 2:
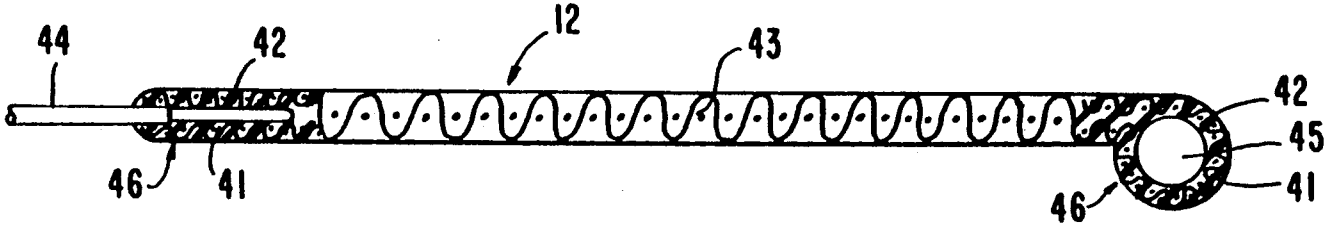
FIG. 2 is a cross sectional view of an inflatable compressible tubular seal according to the invention.

FIG. 2 is a cross sectional view of a seal plate 12 for use in accordance with the present invention. The seal plate 12 may comprise a single layer 43 or plural layers which are gas permeable and formed, for example, of aluminum or stainless steel screen material. The peripheral portions comprise a flexible tubular portion comprising a thin fluid-impermeable wall of a strong flexible wire screen 41 impregnated with heat resistant rubber 42 so as to define a hollow space 45 therewithin to which is connected a suitable gas, e.g. steam, feeding pipe 44. This peripheral edge portion thus defines an inflatable seal 46, the left hand portion of FIG. 2 showing the seal in its uninflated or deflated state and right hand side of FIG. 2 showing the seal in its inflated condition. It will be understood that the reinforcing screen wire 41 prevents the seal 46 from elastically inflating like a balloon.

Where closed steam pressing is desirable, it will be understood that the plates 10 and 12 can be placed adjacent one another, the seal 46 inflated by the injection of steam or other gas into the hollow 45, and the steam injected through pipe 36 from which it passes through the layers 35, 34 and 43 and then into the product under consolidation. The inflatable seal 46 of FIG. 2 is applicable in any press, be it a conventional or a steam injection press or in other consolidation processes for producing flat products, where it is desirable to hermetically enclose the product during the consolidation.

Figure 3:
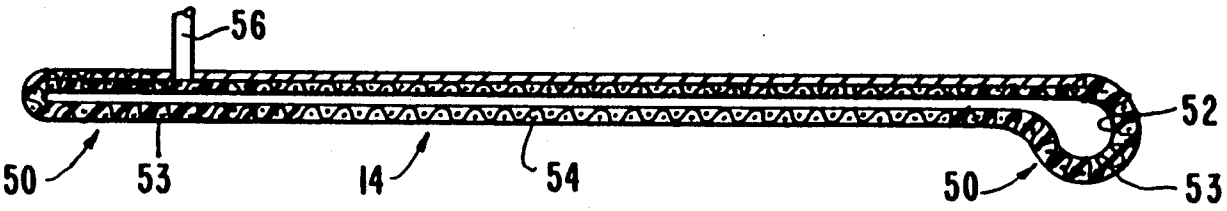
FIG. 3 is a cross sectional view of another embodiment which combines the steam distribution plate and inflatable seal into one seal-plate.

Also for closed steam pressing, reference is made to FIG. 3, which shows a cross sectional view of a variant of the apparatus which combines the steam distribution plate and an inflatable seal in one seal-plate 14. In FIG. 3, the central area of the seal-plate 14 is formed by a first sheet 51 and gas permeable second sheet 54, with a gas permeable intermediate sheet 55 being disposed therebetween. All of the sheets may be gas permeable or the first sheet 51 can be impermeable. The peripheral part of the seal-plate 14 defines a seal portion 50 made of a fluid impermeable flexible inner layer 52, which is made of a heat resistant flexible plastic or rubber material, such as a silicone rubber, and a thin strong outer flexible screen 53 which is made impermeable to fluids by filling it with said heat resistant flexible material, the seal portion 50 in these regards being similar to the seal 46 of FIG. 2. The peripheral part of the seal-plate is in the shape of a U in the uninflated or deflated state (as shown on the left) and is open toward the center part of the plate with which it forms a continuum.

Figure 4:
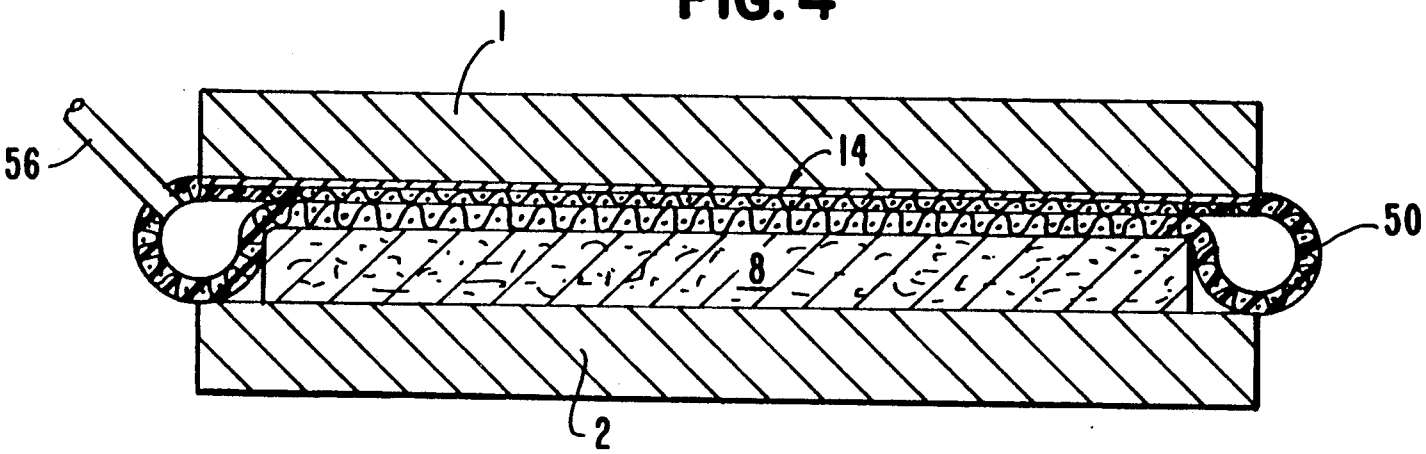
FIG. 4 is a cross sectional view of a press with a press platen on top to which the steam distribution plate of the invention is attached.

The method for using the seal-plate of FIG. 3 for closed steam injection pressing is as follows: after press platens 1 and 2 as depicted in FIG. 4 are moved to their final closed position with the lignocellulosic material squeezed therebetween, or several seconds before they reach their final position, the steam valve is opened and steam is allowed to enter from the pipe 56 into the open space of the plates 55 and 54 of the seal-plate 14. Because the peripheral seal part 50 of the seal-plate 14 is impermeable to steam, the steam passes to the central area of the seal-plate 14 and from there to the board 8 (as shown in FIG. 4) being pressed. After a few seconds of steam injection, the press reaches a final position and the product 8 is compressed and is thereby made less permeable to steam.

As steam begins to fill the voids of the board 8 being pressed, the stream pressure within the seal-plate 14 increases and the peripheral part 50 of the seal-plate 14 becomes filled with steam and inflated, and this produces a peripheral seal between the press platens 1 and 2 thereby preventing further escape of steam through the edges of the product 8. When consolidation is complete, a steam relief valve is opened and steam is released first from the peripheral seal 50 which deflates and then from the product.

When the inflatable seal of either FIG. 2 or FIG. 3 is positioned along the periphery of the press platens in presses for making large area flat panels it causes an airtight compressible seal upon inflation. It is generally desired to form a closed cavity between the press platens around the under consolidation panel, and the tube upon inflation either by air or steam produces an impermeable seal which prevents the fluid from escaping from the panel during its consolidation.

The advantages of utilizing an inflatable tube as a seal 46 or 50 in lieu of a conventional seal are that the former creates a strong tight high pressure seal between the press platens (depending on the pressure with which it is inflated) that is capable of sealing the gap between the press platens of variable sizes from a couple of inches to a fraction of an inch; and that the inflatable tube does not undergo any physical changes such as fatigue, compression set or other degradation upon several thousand times or instances of repeated compression.

The invention devices are useful in peripheral seals in presses used for consolidating various products because of the versatility of such inflatable seals of being usable in a variety of applications, for example when it is desired to keep gases formed in products during pressing which gases are produced by consolidation such as polluting gases from chemical reactions or formaldehyde, or when it is desired to keep in the products being formed such fluids which have been introduced before or during consolidation of the products such as steam or gaseous catalysts for chemical reactions, impregnation chemicals, gaseous components for chemical reactions and the like.

In a closed steam pressing system for consolidation of products, the objective is to keep the gaseous products generated during consolidation within the product, i.e. the fluids produced by consolidation to aid the consolidation. A typical example is in the case of keeping in product fluids produced by consolidation in the production of hardboards by wet or semi-wet processes. Steam and gases produced by vaporization due to hot pressing are kept in the board by the seal 46 during the pressing step and this speeds up curing of the binders and occasions less swelling in the product.

In the context of the invention, consolidation by hot pressing is materially helped by injecting high pressure steam into the product using steam distribution plates 10 as shown in FIG. 1 or the combined steam distribution plate and inflatable seal as a single seal-plate 14, as shown in FIG. 3. When consolidation by hot pressing is performed utilizing the constructions according to FIGS. 1 and 2, high temperature end products are achieved in a very short time and this significantly reduces consolidation time while improving the physical properties of the products.

To convert a conventional press into a closed steam injection pressing in accordance with the invention, each press opening must be equipped with one or two steam distribution plates and one seal. In this connection, reference is made to FIG. 5 which shows a cross-sectional view of a press opening with press platen 1 on top and press platen 2 on the bottom equipped with one distribution plate 12 attached to top press platen 1. Seal 46 is attached to the steam distribution plate 12 and encloses the board 8 being pressed. However, a steam distribution plate 10 may be attached to the bottom press platen 2 and a seal 46 or 50 to the top press platen 1, or both plate and seal in the form of a seal plate 12 or 14 can be attached to the bottom press platen 2 if desired.

When the press platens are moved into position for the consolidation operation, the tube 46 is inflated, either by air or steam up to pressures of about 200 psi, depending upon the pressure of gases in the product under consolidation between the press platens 1 and 2. The pressure in the seal 46 (or 50) must be equal to or greater than the pressure in the products. Alternatively, the seal 46 may be kept permanently inflated at a constant pressure.

When the press platens are moved towards each other and the inflated tube seals are brought into contact with the press platens, an air tight enclosure of products between the press platens is effected. Since the maximum diameter of the inflated tube seal is slightly larger than the maximum thickness of any product produced in the press, a wide range of thicknesses can be close-pressed in the press. The minimum thickness, on the other hand, is equal to the seal thickness in the deflated state and the maximum thickness is equal to a slightly less than the outer diameter of the fully inflated tube seal.

When the tube seal is permanently connected to the source of pressurized fluid, the pressure in the tube seal is constant regardless of what product thickness is produced. When a product thickness less than the maximum is pressed, during closing the press fluid moves out of the tube seal back to its source. When the press cycle opens the press, fluid again moves from the source back into the tube seal to fully reinflate it.

At an appropriate time, steam is injected into product 8 through the steam distribution plate 10 from the pipe 36. The steam injection can start before, simultaneous to or after the tube seal 46 is inflated, and the pressure of steam which is injected into the product 8 will depend upon the desired reaction temperature, the permeability of the product to fluids or other conditions. In those cases where steam can be injected into products simultaneously with or slightly before the tube seal is inflated, a more simplified design of the steam distribution plate and seal can be applied. In this connection, reference is again made to the embodiment of FIG. 3 which shows a cross-sectional view of the apparatus for a closed steam pressing system where the steam distribution plate and the inflatable seal are combined in one seal-plate 14 as already described above.

The various plates 10, 12 and 14 may be attached or affixed to the upper and lower platen 1, 2 in any conventional manner, e.g. by welding, screwing, bolting, or the like. However, when one or more of these plates are used in conjunction with the bottom platen 2, they may merely rest thereon by gravity. When used in conjunction with the upper platen 1, they may be placed on the product 8 without being connected to the platen 1.

The process and apparatus for affecting closed steam pressing according to the invention will become clearer by reference to the following non-limitative examples.

EXAMPLE 1

Each press opening with press platens at 400° F. is equipped with a seal according to FIG. 2, and is connected to a source of steam. A wet lignocellulose fiber mat containing between 15 to 40% moisture content is deposited in the press opening and the press is closed to a position to obtain a wet board thickness of ½ inch thick having a specific gravity of approximately 0.95. The press closing results in mechanical squeezing-out of a part of the water from the mat, and after evaporation of the water from the surface layers in contact with the hot press platens starts, the seal 46 is inflated to a pressure about 210 psi in order to prevent steam from escaping from the board.

Steam from the surface layers migrates towards the board center which results in a rapid increase in the temperature, and in a relatively short time steam pressure in the board is built up. When the pressure reaches the level of about 200 psi, the seal is deflated and the steam is released from the board. By repeating the steam pressure built-up and steam release, the moisture content of the board is rapidly reduced, and when the moisture content reaches a level of between 5 to 8%, the board is fully consolidated and is removed from the press.

This procedure of consolidation using the closed steam pressing with the seal of FIG. 2 requires between 6 and 7 minutes and the boards have a higher than normal internal bond and lower thickness swelling.

COMPARATIVE EXAMPLE 1

The procedure of Example 1 is repeated to consolidate a similar board using a conventional press without the seal of FIG. 2. The time needed to complete a pressing operation using this conventional pressing procedure is over 15 minutes, and the thickness swelling of the board is higher than that of the board produced in Example 1.

EXAMPLE 2

A wood fiber mat of 0.5 inch board of about 15% moisture content is consolidated in the press opening according to example 1 wherein the press platens are at about 400° F. and the press is equipped with a seal according to FIG. 2. When the press is closed to a final board thickness, the seal is inflated to about 200 psi pressure, and the board is kept between press platens until steam pressure in the board reaches between 150 and 180 psi, whereupon the seal is deflated and steam is released from the board. By the use of this sealed pressing, the press time is reduced to about 7 minutes or one-half of the time needed for a board of the same density (0.95) and the internal bond and thickness swelling are also improved as shown by.

EXAMPLE 3

A press opening of a conventional press with press platens at a temperature of about 350° F. is equipped with steam distribution plates according to FIG. 1. A particle board 1.75 inches thick and of 30 lb/ft$^3$ density is bonded with urea formaldehyde resin and pressed. Approximately ten seconds before the press platens reach a final position, the steam valve is opened and steam at 60 to 80 psi pressure is injected into the board for about 15 seconds. Thereafter, the board is kept between the press platens under pressure for an additional 45 seconds. The press is then opened and the board removed. The pressing time by steam injection is reduced to 1/5 of the press time needed for conventional pressing, and the board is more homogeneous and characterized by better physical properties.

EXAMPLE 4

Figure 5:
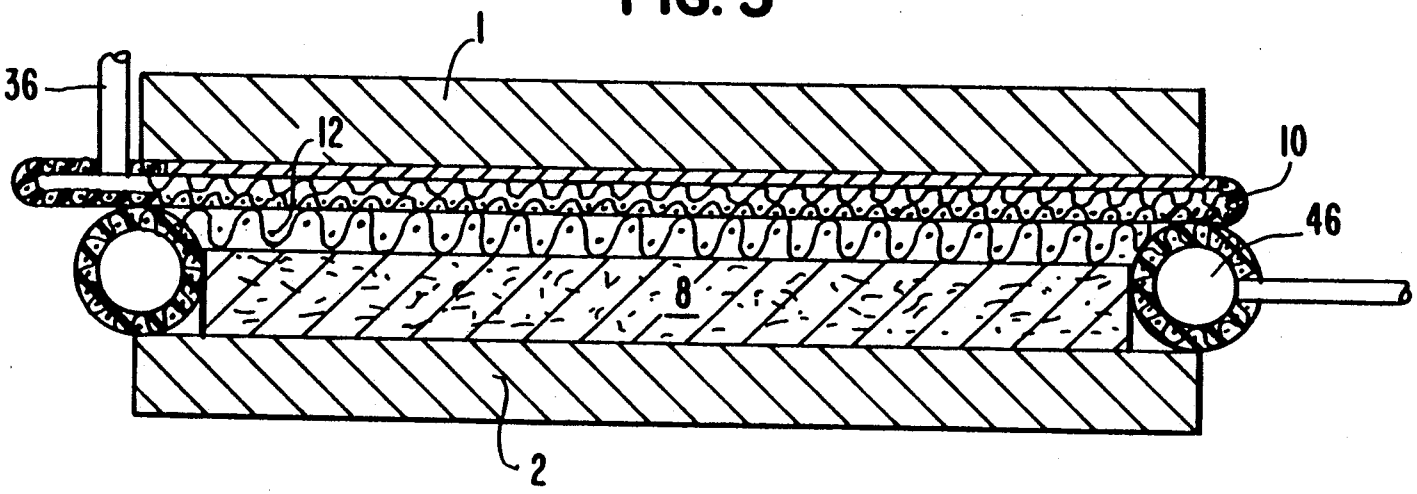
FIG. 5 is a cross sectional view of a press with a press platen on top and a press platen on the bottom equipped with one distribution plate attached to the top press platen and the seal attached to the steam distribution plate encloses a pressed board.

The press openings are equipped with steam distribution plates of the construction depicted in FIG. 1 and the seals used in FIG. 2 such as shown in FIG. 5. A medium density ¾ inch thick wood particle board is pressed using a carbohydrate binder in accordance with Stofko U.S. Pat. No. 4,183,997. Approximately fifteen seconds before the press platens reach their final position, the steam valve controlling the steam inlet to the steam distribution plate is opened and steam at a pressure of 150 psi is injected into the board. When the press is closed to the final thickness, the valve controlling the steam inlet to the seal tube is opened and the seal is inflated by steam to 160 psi pressure. Steam at 150 psi pressure is kept in the board and 160 psi is kept in the seal for two minutes, whereupon these pressures are released from both the board and the seal. After an additional minute, the press is opened and the board is removed from the press. Good physical properties are achieved in a reduced press time and this is not obtainable without the use of the closed steam pressing system as described.

EXAMPLE 5

The press opening of a conventional press is equipped with a seal plate according to that shown in FIG. 3. Douglas fir veneers for five ply ⅝ inch board are spread with a standard glue mix of phenol formaldehyde resin and pre-pressed for about three minutes after an open assembly time of about 5 minutes. After the press is closed to a pressure of 175 psi on the plywood panel, the steam valve is opened and steam at 100 psi is injected into the panel. After about 10 seconds of steam injection, the tube seal of the seal-plate becomes inflated, and the board sealed between the press platens. Steam is kept in the plywood for three minutes and the steam pressure and hydraulic pressure are then released and the board removed from the press. The press time and the plywood compression are reduced by about 50% and standard board quality is maintained.

While the description above is directed primarily to the consolidation of wood products, it will be understood that the apparatus of the present invention can be used for press consolidation of other materials as well, whether or not steam is used. For example, such apparatus can be used to inject various types of gases or vapors, including mixtures, for example for impregnation, sterilization, etc.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. A steam distribution device for use in consolidation of products by heat and pressure in a closed steam injection pressing apparatus, comprising:
   - a central plate including an upper central layer of a sheet forming one surface of said device, and a lower central layer of a fluid permeable sheet forming a second surface of said device;
   - a peripheral part of a hollow tubular seal device including a fluid impermeable flexible inner layer made of a heat resistant plastic material and an outer flexible non-expandable screen having open spaces filled with flexible heat resistant material; and
   - a gas inlet line disposed to supply gas into the hollow of the peripheral tubular seal device.

2. A steam distributing device in accordance with claim 1 wherein said gas inlet line for connection to a source of steam, and the hollow of said hollow tubular seal device is fluidly connected to said lower central layer of said fluid permeable sheet whereby steam fed through said gas inlet line to the hollow of said peripheral tubular seal device passes from said hollow to said lower central layer of said fluid permeable sheet.

3. In combination, a press opening of a steam injection pressing system comprising the steam distribution device of claim 1, a press platen removably affixed to a top of said plate and one press platen disposed beneath a product to be compressed, so that said steam distribution device and said platen beneath encloses said product to be compressed.

4. A compressible seal device for use with a gas distribution plate in a press, said seal device comprising a flat fluid permeable central section and an inflatable tubular seal surrounding said central section, said tubular seal including an inner layer of a heat resistant fluid impermeable material united with an outer layer made of a fluid permeable wire screen, said tubular seal having a gas inlet line disposed to introduce gas into and inflate said tubular seal.

5. In combination, a press opening of a steam injection pressing system comprising the inflatable compressible seal device of claim 4, a steam distribution plate removably affixed to said seal device, one press platen on top of said plate and one press platen disposed beneath a product to be compressed, so that said seal device affixed to said distribution plate and said platen beneath encloses said product to be compressed.

* * * * *